US008140326B2

(12) United States Patent
Chen et al.

(10) Patent No.: US 8,140,326 B2
(45) Date of Patent: Mar. 20, 2012

(54) SYSTEMS AND METHODS FOR REDUCING SPEECH INTELLIGIBILITY WHILE PRESERVING ENVIRONMENTAL SOUNDS

(75) Inventors: Francine Chen, Palo Alto, CA (US); John Adcock, Menlo Park, CA (US)

(73) Assignee: Fuji Xerox Co., Ltd., Tokyo (JP)

( * ) Notice: Subject to any disclaimer, the term of this patent is extended or adjusted under 35 U.S.C. 154(b) by 831 days.

(21) Appl. No.: 12/135,131

(22) Filed: Jun. 6, 2008

(65) Prior Publication Data

US 2009/0306988 A1 Dec. 10, 2009

(51) Int. Cl.
*G10L 21/02* (2006.01)
*G10L 19/00* (2006.01)
*G10L 13/06* (2006.01)

(52) U.S. Cl. ..... 704/226; 704/219; 704/261; 704/262; 704/264

(58) Field of Classification Search ..... None
See application file for complete search history.

(56) References Cited

U.S. PATENT DOCUMENTS 5,119,425 A * 6/1992 Rosenstrach et al. ..... 704/219
5,750,912 A * 5/1998 Matsumoto ..... 84/609
5,893,056 A * 4/1999 Saikaly et al. ..... 704/226
6,829,577 B1 * 12/2004 Gleason ..... 704/207
7,243,065 B2 * 7/2007 Stephens et al. ..... 704/226
7,363,227 B2 * 4/2008 Mapes-Riordan et al. ... 704/273
7,765,101 B2 * 7/2010 En-Najjary et al. ..... 704/246
7,831,420 B2 * 11/2010 Sinder et al. ..... 704/225
8,065,138 B2 * 11/2011 Akagi et al. ..... 704/205
2007/0055513 A1 * 3/2007 Hwang et al. ..... 704/233
2009/0125301 A1 * 5/2009 Master et al. ..... 704/208
2009/0281807 A1 * 11/2009 Hirose et al. ..... 704/254

OTHER PUBLICATIONS

Cole, R.A., Yonghong Yan, B. Mak, M. Fanty, T. Bailey. "The contribution of consonants versus vowels to word recognition in fluent speech," Proc. ICASSP-96, vol. 2, pp. 853-856, 1996.
Kewley-Port, et al., "Contribution of consonant versus vowel information to sentence intelligibility for young normal-hearing and elderly hearingimpaired listeners," The Journal of the Acoustical Society of America. vol. 22(4), pp. 2365-2375, 2007.
Garofolo, J. S., et al., "TIMIT acoustic-phonetic continuous speech corpus," Linguistic Data Consortium, Philadelphia.

(Continued)

*Primary Examiner* — Matthew Sked
(74) *Attorney, Agent, or Firm* — Sughrue Mion, PLLC

(57) ABSTRACT

An audio privacy system reduces the intelligibility of speech in an audio signal while preserving prosodic information, such as pitch, relative energy and intonation so that a listener has the ability to recognize environmental sounds but not the speech itself. An audio signal is processed to separate non-vocalic information, such as pitch and relative energy of speech, from vocalic regions, after which syllables are identified within the vocalic regions. Representations of the vocalic regions are computed to produce a vocal tract transfer function and an excitation. The vocal tract transfer function for each syllable is then replaced with the vocal tract transfer function from another prerecorded vocalic sound. In one aspect, the identity of the replacement vocalic sound is independent of the identity of the syllable being replaced. A modified audio signal is then synthesized with the original prosodic information and the modified vocal tract transfer function to produce unintelligible speech that preserves the pitch and energy of the speech as well as environmental sounds.

34 Claims, 3 Drawing Sheets

OTHER PUBLICATIONS

Vallejo, G., "*ListenIN: Ambient Auditory Awareness at Remote Places*" . M.S. Thesis, Program in Media Arts and Sciences, MIT Media Lab, Sep. 2003. http://www.media.mit.edu/speech/papers/2003/vallejo_thesis03 pdf.

Schmandt, C., et al., "*ListenIn" to Domestic Environments from Remote Locations*. Proceedings of the 2003 International Conference on Auditory Display, Boston, MA, USA, Jul. 6-9, 2003. http://www.media.mit.edu/speech/papers/2003/schmandt_ICAD03_listenin.pdf.

Girgensohn, A., et al., *Being in Public and Reciprocity: Design for Portholes and User Preference*. In Proceedings of Interact'99: IFIP TC.13 International Conference on Human-Computer Interaction, IOS Press, pp. 458-465, 1999.

Wyatt, D., et al. *Conversation Detection and Speaker Segmentation in Privacy Sensitive Situated Speech Data*. To appear in the Proceedings of Interspeech 2007.

Zhang, Yaxin *Voiced/unvoiced speech classifier*. US Patent No. 6640208.

http ://www.dspexperts.com/dsp/projects/lpc/, This page had links to software for computing LPC. However, at the time of this writeup, the page was unavailable.

Wong,Gauthier, Hayward and Cheung (2006). "Font tuning associated with expertise in letter perception." Perception, 35, 541-559.

Caine, Kelly "Privacy Perceptions of Visual Sensing Devices: Effects of Users' Ability and Type of Sensing Device," M.S. thesis, Georgia Institute of Technology, 2006. http://smartech.gatech.edu/dspace/handle/1853/11581.

Chappell, David T. et al., (1998): "Spectral smoothing for concatenative speech synthesis", In *ICSLP-1998*, paper 0849.

Griffin, Daniel W. Multi-band excitation vocoder Massachusetts Institute of Technology, 1987 Ph.D. thesis http://hdl.handle.net/1721.1/4219.

Campbell J. et al., Voiced/unvoiced classifcation of speech with applications to the U.S. Government LPC-10e algorithm. IEEE Int. Conf. Acoust. Sp. Sig. Proc., 1986 p. 473-476.

S.F. Boll, Suppression of acoustic noise in speech using spectral subtraction, IEEE Trans. Acoust., Speech, Signal Process., vol. 27, pp. 113-120, Apr. 1979.

Golberg, R. et al., A Practical Handbook of Speech Coders, CRC Press, 2000.

Smith Ian, et al., *Low Disturbance Audio for Awareness in Media Space Applications*. ACM Multimedia 95—Electronic Proceedings, Nov. 5-9, 1995 San Francisco, CA. http://doi.acm.org/10.1145/217279.215253.

* cited by examiner

SYSTEMS AND METHODS FOR REDUCING SPEECH INTELLIGIBILITY WHILE PRESERVING ENVIRONMENTAL SOUNDS

BACKGROUND OF THE INVENTION

1. Field of the Invention

The present invention relates to systems and methods for reducing speech intelligibility while preserving environmental sounds, and more specifically to identifying and modifying vocalic regions of an audio signal using a vocal tract model from a prerecorded vocalic sound.

2. Background of the Invention

Audio communication can be an important component of many electronically mediated environments such as virtual environments, surveillance, and remote collaboration systems. In addition to providing a traditional verbal communication channel, audio can also provide useful contextual information without intelligible speech. In certain situations (elder care, surveillance, workplace collaboration and virtual collaboration spaces) audio monitoring that obfuscates spoken content to preserve privacy while allowing a remote listener to appreciate other aspects of the auditory scene may be valuable. By reducing the intelligibility of the speech, these applications can be enabled without an unacceptable loss of privacy.

In situations which involve remote monitoring such as security surveillance, home monitoring of the elderly, or always-on remote awareness and collaboration systems, people often raise privacy concerns. Video monitoring has been noted to be intrusive by elderly people. Kelly Caine, "Privacy Perceptions of Visual Sensing Devices: Effects of Users' Ability and Type of Sensing Device," M.S. thesis, Georgia Institute of Technology, 2006. http://smartech.gatech.edu/dspace/handle/1853/11581. In the security scenario, sounds such as glass breaking, gunshots, or yelling are indicative of events that should be investigated. In the elder care scenario, examples of sounds which might indicate intervention is needed are a tea kettle whistling for a long time, the sound of something falling, or the sound of someone crying. Therefore, it is desired to develop a system for monitoring audio signals that balances the privacy interests of the recorded speaker but also provides needed environmental and prosodic information for security and safety monitoring applications.

Remote workplace awareness is another scenario where an audio channel that gives the remote observer a sense of presence and knowledge of what activities are occurring without creating a complete loss of privacy can be valuable.

Cole et al. studied the influence of consonants and of vowels on word recognition using a subset of the sentences in the TIMIT corpus. R. A. Cole, Yonghong Yan, B. Mak, M. Fanty, T. Bailey. "The contribution of consonants versus vowels to word recognition in fluent speech," Proc. ICASSP-96, vol. 2, pp. 853-856, 1996, and John S. Garofolo, Lori F. Lamel, William M. Fisher, Jonathan G. Fiscus, David S. Pallett, Nancy L. Dahlgren, and Victor Zue. "TIMIT acoustic-phonetic continuous speech corpus," Linguistic Data Consortium, Philadelphia http://www.ldc.upenn.edu/Catalog/CatalogEntry.jsp?catalogId=LDC93S1. They tried manually substituting noise for different types of sounds, such as consonants only and vowels only, and let subjects listen to each sentence up to five times. They found that when only vowels were replaced with noise, their subjects recognized 81.9% of the words and recognized all the words in a sentence 49.8% of the time. They found that when vowels plus weak sonorants (e.g.: l, r, y, w, m, n, ng) were replaced with noise, their subjects recognized 14.4% of the words on average, and none of the sentences were completely correctly understood.

Kewley-Port et al. (2007) did a follow-on study to the first condition in Cole et al. (1996) where only vowels are manually replaced with shaped noise. Diane Kewley-Port, T. Zachary Burkle, and Jae Hee Lee, "Contribution of consonant versus vowel information to sentence intelligibility for young normal-hearing and elderly hearing-impaired listeners," The Journal of the Acoustical Society of America. Vol. 22(4), pp. 2365-2375, 2007. In contrast to Cole et al., subjects were allowed to listen to each sentence up to two times. Their subjects performed worse in identifying words in TIMIT sentences, with 33.99% of the words correctly identified per sentence, indicating that being able to listen to sentence more than twice may improve intelligibility.

Kewley-Port and Cole both found that when only vowels are replaced by noise, intelligibility of words is reduced. Cole additionally found that replacing vowels plus weak sonorants by noise reduces intelligibility so that no sentences are completely recognized and only 14.4% of the words are recognized.

For audio privacy, it is desired to reduce the intelligibility of words to less than 14.4%, and ideally as to close to 0% as possible, while still keeping most environmental sounds recognizable and keeping the speech sounding like speech.

SUMMARY OF THE INVENTION

The present invention relates to systems and methods for reducing the intelligibility of speech in an audio signal while preserving prosodic information and environmental sounds. An audio signal is processed to separate vocalic regions from prosodic information, such as pitch and relative energy of speech, after which syllables are identified within the vocalic regions. A vocal tract transfer function for each syllable is then replaced with the vocal tract transfer function from one or more separate, prerecorded vocalic sounds. In one aspect, the identity of the replacement vocalic sound is independent of the identity of the syllable being replaced. The modified vocal tract transfer function is then synthesized with the original prosodic information to produce a modified audio signal with unintelligible speech that preserves the pitch and energy of the speech as well as environmental sounds.

The present invention also relates to a method for reducing speech intelligibility while preserving environmental sounds, the method comprising receiving an audio signal; processing the audio signal to separate a vocalic region; computing a representation of at least the vocalic region, the representation including at least a vocal tract transfer function and an excitation; replacing the vocal tract transfer function of the vocalic region with a replacement sound transfer function of a replacement sound to create a modified vocal tract transfer function; and synthesizing a modified audio signal of at least the vocalic region from the modified vocal tract transfer function and the excitation.

In another aspect of the invention, the method further comprises substituting the audio signal of at least the vocalic region with the modified audio signal to create an obfuscated audio signal.

In another aspect of the invention, the method further comprises processing the audio signal using a Linear Predictive Coding ("LPC") technique.

In another aspect of the invention, the method further comprises computing LPC coefficients of the replacement sound and the vocalic region, and replacing the LPC coefficients of the vocalic region with the LPC coefficients of the replacement sound.

In another aspect of the invention, the method further comprises processing the audio signal using a cepstral technique.

In another aspect of the invention, the method further comprises processing the audio signal using a Multi-Band Excitation ("MBE") vocoder.

In another aspect of the invention, the method further comprises identifying syllables within the vocalic region before computing the vocal tract transfer function.

In another aspect of the invention, the method further comprises identifying the syllables within each vocalic region by identifying voiced segments and identifying syllable boundaries.

In another aspect of the invention, the method further comprises identifying vocalic syllables within the range of human speech by evaluating a pitch and a voicing ratio computed by a voicing detector.

In another aspect of the invention, the method further comprises selecting a vocalic sound as the replacement sound.

In another aspect of the invention, the method further comprises selecting a tone or a synthesized vowel as the replacement sound.

In another aspect of the invention, the method further comprises selecting a vocalic sound spoken by another speaker as the replacement sound.

In another aspect of the invention, the method further comprises selecting the replacement sound independently of the vocal tract transfer function being replaced.

In another aspect of the invention, the method further comprises randomly selecting the replacement sound.

In another aspect of the invention, the method further comprises replacing each vocal tract transfer function with a different replacement sound transfer function.

In another aspect of the invention, the method further comprises modifying the excitation.

In another aspect of the invention, the method further comprises, upon receiving the audio signal, separating the audio signal into rapidly-varying components and slowly-varying components.

The present invention also relates to a system for reducing speech intelligibility while preserving environmental sounds, the system comprising a receiving module for receiving an audio signal; a voicing detector for processing the audio signal to separate a vocalic region; a computation module for computing a representation of at least the vocalic regions, the representation including at least a vocal tract transfer function and an excitation; a replacement module for replacing the vocal tract transfer function of the vocalic region with a replacement vocal tract transfer function of a replacement sound to create a modified vocal tract transfer function; and an audio synthesizer for synthesizing a modified audio signal of at least the vocalic region from the modified vocal tract transfer function and the excitation.

In another aspect of the invention, the system includes a substitution module for substituting the audio signal of at least the vocalic region with the modified audio signal to create an obfuscated audio signal.

In another aspect of the invention, the audio signal is processed using a Linear Predictive Coding ("LPC") technique.

In another aspect of the invention, the system includes an LPC computation voicing detector to compute LPC coefficients of the replacement sound and the vocalic region, and wherein the replacement module replaces the LPC coefficients of the vocalic region with the LPC coefficients of the replacement sound.

In another aspect of the invention, the audio signal is processed using a cepstral technique.

In another aspect of the invention, the audio signal is processed using a Multi-Band Excitation ("MBE") vocoder.

In another aspect of the invention, the system includes a vocalic syllable detector to identify the syllables within the vocalic region before computing the vocal tract transfer function.

In another aspect of the invention, the syllable detector identifies the syllables by identifying voiced segments and syllable boundaries.

In another aspect of the invention, the syllable detector identifies vocalic syllables within the range of human speech by evaluating the pitch and voicing ratio computed by a voicing detector.

In another aspect of the invention, the replacement module selects a vocalic sound as the replacement sound.

In another aspect of the invention, the replacement module selects a tone or synthesized vowel as the replacement sound.

In another aspect of the invention, the replacement module replaces the vocal tract transfer function of each vocalic region with a vocalic sound spoken by another speaker.

In another aspect of the invention, the replacement module selects the replacement sound independently of the vocal tract transfer function being replaced.

In another aspect of the invention, the replacement module randomly selects the replacement sound.

In another aspect of the invention, the replacement module replaces each vocal tract transfer function with a different replacement sound transfer function.

In another aspect of the invention, the system includes an excitation module for modifying the excitation.

In another aspect of the invention, the receiving module, upon receiving the audio signal, separates the audio signal into rapidly-varying components and slowly-varying components.

Additional aspects related to the invention will be set forth in part in the description which follows, and in part will be obvious from the description, or may be learned by practice of the invention. Aspects of the invention may be realized and attained by means of the elements and combinations of various elements and aspects particularly pointed out in the following detailed description and the appended claims.

It is to be understood that both the foregoing and the following descriptions are exemplary and explanatory only and are not intended to limit the claimed invention or application thereof in any manner whatsoever.

BRIEF DESCRIPTION OF THE DRAWINGS

The accompanying drawings, which are incorporated in and constitute a part of this specification exemplify the embodiments of the present invention and, together with the description, serve to explain and illustrate principles of the inventive technique. Specifically.

DETAILED DESCRIPTION OF THE INVENTION

Figure 1:
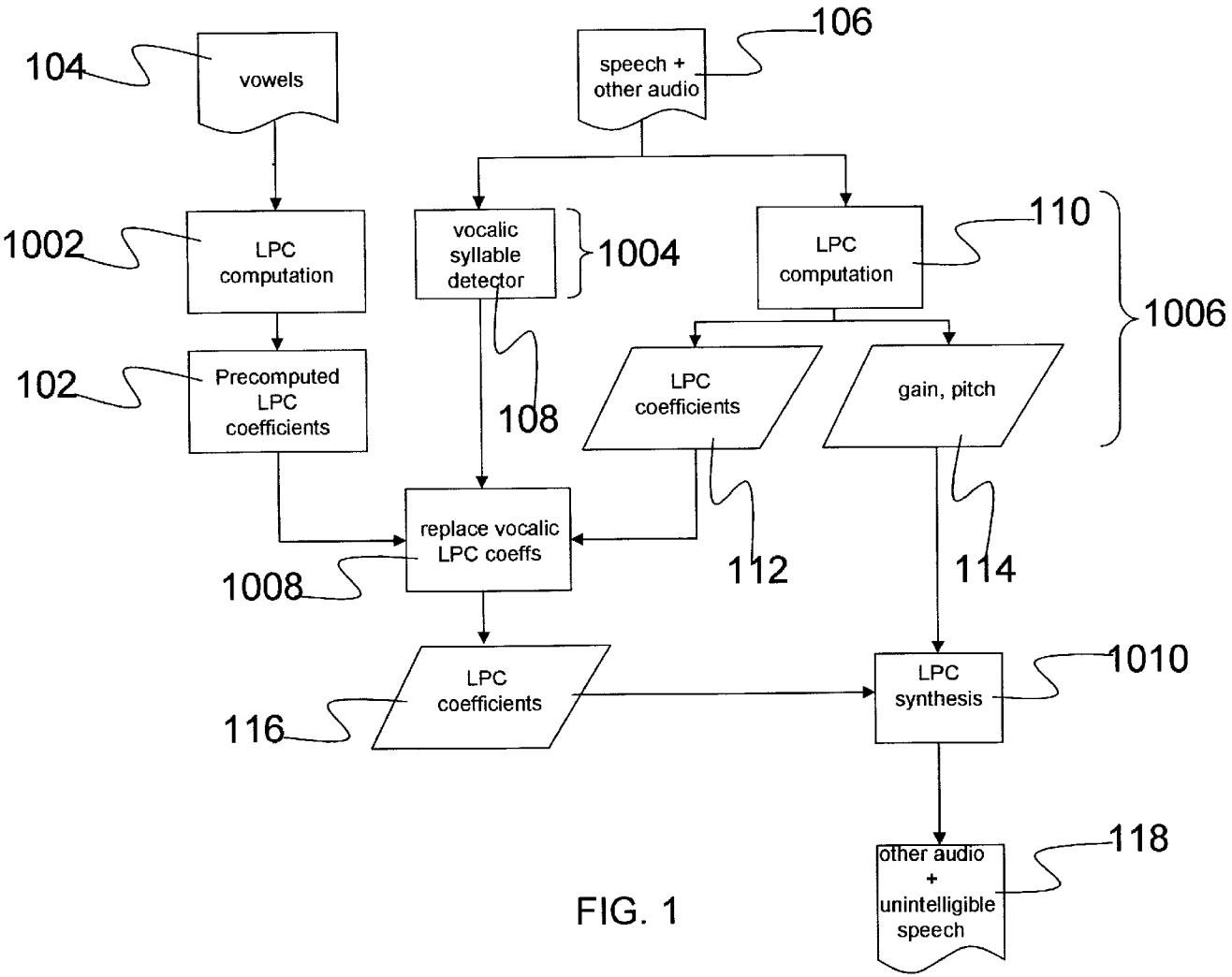
FIG. 1 depicts a method for reducing the intelligibility of speech in an audio signal, according to one aspect of the invention.

In the following detailed description, reference will be made to the accompanying drawing(s), in which identical functional elements are designated with like numerals. The aforementioned accompanying drawings show by way of illustration and not by way of limitation, specific embodiments and implementations consistent with principles of the present invention. These implementations are described in sufficient detail to enable those skilled in the art to practice the invention and it is to be understood that other implementations may be utilized and that structural changes and/or substitutions of various elements may be made without departing from the scope and spirit of present invention. The following detailed description is, therefore, not to be construed in a limited sense. Additionally, the various embodiments of the invention as described may be implemented in the form of software running on a general purpose computer, in the form of a specialized hardware, or combination of software and hardware.

The present invention relates to systems and methods for reducing the intelligibility of speech in an audio signal while preserving prosodic information and environmental sounds. An audio signal is processed to separate vocalic regions, after which a representation is computed of at least the vocalic regions to produce a vocal tract transfer function and an excitation. A vocal tract transfer function is then replaced with a replacement sound transfer function from a separate, prerecorded replacement sound. The modified vocal tract transfer function is then synthesized with the excitation to produce a modified audio signal of at least the vocalic regions with unintelligible speech that preserves the pitch and energy of the speech as well as environmental sounds. In an additional aspect, the original audio signal of at least the vocalic regions is substituted with the modified audio signal to create an obfuscated audio signal.

In accordance with an embodiment of the invention, to reduce the intelligibility of speech while preserving intonation and the ability to recognize most environmental sounds, vocalic regions are identified and the vocal tract transfer function of the identified vocalic regions is replaced with a replacement vocal tract transfer function from prerecorded vowels or vocalic sounds. First, voiced regions where the pitch is within the normal range of human speech are identified. To maintain the spoken rhythm, within each voiced region, syllables are identified based on the energy contour. The vocal tract transfer function for each syllable is replaced with the replacement vocal tract transfer function from another speaker saying a vowel, or vocalic sound, where the identity of the replacement vocalic is independent of the identity of the spoken syllable. The audio signal is then resynthesized using the original pitch and energy, but with the modified vocal tract transfer function.

In accordance with an embodiment of the invention, in a monitoring application, audio monitoring with the speech processed to be unintelligible is less intrusive than unprocessed speech. Such audio monitoring could be used as an alternative to or an extension of video monitoring. By preserving environmental sounds during processing, monitoring can still be performed to identify sounds of interest. By preserving the nature and identifiability of environmental sounds, the audio monitoring can provide valuable remote awareness without overly compromising the privacy of the monitored. Such a monitoring system is valuable in augmenting a system with the ability to automatically detect important sounds, since the list of important sounds can be diverse and possibly open-ended.

In one embodiment, in order to further reduce the intelligibility of speech in an audio signal, rather than replacing the vocalic with noise so that a listener can focus on the consonants, the vocalic portion of a syllable is replaced with unrelated vocalics. In one aspect, the unrelated vocalics are produced by a different vocal tract, but the speaker's non-vocalic sounds, including prosodic information, is retained. Instead of using white, periodic, or shaped noise, the vocal tract from the vocalic portion of each syllable that was originally spoken is substituted with a vocalic from another pre-recorded speaker. This reduces intelligibility because the listener cannot simply attend to only the consonants and ignore the noise; the listener must now also try to figure out which of the vocalics are correct (only a small proportion, since English has over 15 vowels, with up to 20 if the different dialects are combined). Additionally, it has been noted that intelligibility is better when listening to one speaker than when tested on multiple speakers, and the use of different vocal tracts, often with the wrong vocalic, provides a further confounding effect. Gauthier, Wong, Hayward and Cheung (2006). "Font tuning associated with expertise in letter perception." Perception, 35, 541-559.

In one embodiment of the invention, a method for automatically reducing speech intelligibility is described. In previously described concepts, the location of consonants, vowels, and weak sonorants were hand-labeled, and the hand-labeling was used to determine which part of the speech signal should be replaced with noise. In the automatic approach, it is noted that vowels, plus weak sonorants are all voiced, or vocalics, and so intelligibility can be reduced by modifying the vocalic region of each syllable.

In the monitoring scenario described herein, it is desirable to preserve prosodic information, that is, pitch and relative energy. By doing so, a listener can identify speech from other sounds, and if someone sounds distressed, then the listener/monitor should be able to tell that from the audio. At the same time, the environmental sounds are preserved as much as possible. To accomplish these criteria, the speech signal is processed to separate the prosodic information from the vocal tract information. There are several techniques for speech analysis that may be used, including Linear Prediction Coding ("LPC"), cepstral and multi-band excitation representations. In the embodiment described herein, LPC is used for performing this separation processing, although one skilled in the art will appreciate that numerous other techniques for spectral analysis are possible.

In one aspect of the invention, the LPC coefficients representing a vocal tract transfer function of the vocalics in the input speech are replaced with stored LPC coefficients from sonorants spoken by previously recorded speakers. In one particular implementation, relatively steady state vowels extracted from TIMIT training speakers are used. Details of TIMIT is described in John S. Garofolo, Lori F. Lamel, William M. Fisher, Jonathan G. Fiscus, David S. Pallett, Nancy L. Dahlgren, and Victor Zue. "TIMIT acoustic-phonetic continuous speech corpus," Linguistic Data Consortium, Philadelphia, 1993, at http://www.ldc.upenn.edu/Catalog/CatalogEntry.jsp?catalogId=LDC93S1, the content of which is incorporated herein by reference.

FIG. 1 is an overview of one embodiment of the system and method for reducing speech intelligibility using an LPC computation. In step 1002, the LPC coefficients 102 of prerecorded vocalics 104 are computed by an LPC processor. The input audio signal 106 from the receiving module contains speech to be rendered unintelligible. In step 1004, voiced regions are identified in the input speech and then syllables, if any, are found within each voiced region using the vocalic syllable detector 108. The pitch can be computed by the LPC computation voicing detector 110 in step 1006, generating the LPC coefficients 112 and the gain/pitch 114, which are separated from the vocalic syllables (not shown). In the vocalic syllable detector 108, the voicing ratio is computed, either from the LPC computation or separately, thus identifying vocalic syllables with a pitch within the range of human speech. In step 1008, the LPC coefficients 112 of the identified vocalic syllables are then replaced with one of the precomputed LPC coefficients 102 by a replacement module, generating modified LPC coefficients 116. The LPC coefficients are left unchanged for the portions of the signal that are not recognized as vocalic syllables. Using the gain and pitch 114 computed from the original input speech 106, together with the modified LPC coefficients 114, the unintelligible speech is synthesized by an audio synthesizer in step 1010. The resulting modified audio signal 118 includes unintelligible speech, but preserves the gain and pitch of the original speech, as well as any environmental sounds that were present. In the synthesis step 1010, the entire modified audio signal 118 may be synthesized from the modified LPC coefficients 116 in the new LPC representation. Alternatively, the modified audio signal 118 of the vocalic region is synthesized from the replacement vocal tract function and the excitation. A substitution module substitutes the modified audio signal 118 for only those portions of the original audio signal 106 that correspond to the modified audio signal 118, resulting in an obfuscated audio signal.

Vocalic Syllable Detection

As discussed earlier, in one embodiment, the LPC coefficients 112 of the vocalic portion of each syllable are replaced with precomputed, stored LPC coefficients 102 from another speaker. The first step in vocalic syllable detection (step 1004, above) is to identify voiced segments and then the syllable boundaries within each voiced segment.

First, for a short segment of audio, the autocorrelation is computed. The offset of the peak value of the autocorrelation determines the estimate of the pitch (the offset or lag of the peak autocorrelation value corresponds to the period of the pitch), and the ratio of the peak value of the autocorrelation to the total energy in the analysis frame provides a measure of the degree of voicing (voicing ratio). These algorithms are widely known and described in U.S. Pat. No. 6,640,208, to Zhang et al., the contents of which are herein incorporated by reference. Other methods of computing voicing can be used, such as the voicing classifier described in. J. Campbell and T. Tremain, "Voiced/unvoiced classification of speech with applications to the U.S. Government LPC-10e algorithm," IEEE Int. Conf. Acoust. Sp. Sig. Proc., 1986 p. 473-476, the contents of which is herein incorporated by reference.

In one aspect, if the estimated pitch is within plausible values for adult speech and the voicing ratio is greater than a given (0.2), then the speech is identified as vocalic.

Syllable boundaries are identified based on energy, such as the gain or pitch. In one embodiment, the gain, G, is computed from the LPC model. G is smoothed using a lowpass filter using a cutoff frequency of 100 Hz. Within a voiced segment local minima are identified and the location of the minimum value of G in each dip is identified as a syllable boundary.

Selection of Precomputed Vocalics

There are many vocalic sounds and combinations of vocalic sounds that may be used as the replacement vocal tract transfer function. The selected sound(s) influence the perceptual quality of the modified audio. For example, the use of the weak sonorant /wa/ was found to produce a "beating" sound when the vocalic syllable detector made an error. It could be useful if some other processing to smooth the transitions, e.g., spectral smoothing, is also used.

One approach to selection of precomputed vocalics is to use a relatively neutral vowel, such as /ae/, spoken by a lower-pitched female or higher-pitched male. Here, the idea is that the use of a more neutral vowel generally results in less distortion when the vocalic syllable detector makes an error than when more extreme vowels such as /iy/ or /uw/ are used. The use of /ae/ resulted in reduced intelligibility, but a small percentage of words were still intelligible, based on informally listening to the processed sentences.

To decrease the intelligibility further, two different replacement vowels were then selected, one from a lower-pitched female and one from a higher-pitched male, with the female speaking /iy/ and the male speaking /uw/. This resulted in reduced intelligibility. However, /iy/ is a common vowel and /iy/ and /uw/ have very different vocal tract configurations, leading to a unnatural sound when two vocalic syllables are adjacent. Informally, using a male and a female speaking /uw/ as replacement vowels reduced the unnatural transitions. In one embodiment, the unnatural transitions could also be reduced in other ways, such as spectral smoothing, described in David T. Chappell, John H. L. Hansen, (1998): "Spectral smoothing for concatenative speech synthesis", In *ICSLP*-1998, paper 0849, the details of which are incorporated herein by reference.

One skilled in the art will appreciate that other modifications to the selection of precomputed replacement vocalic LPC coefficients can be performed to further decrease intelligibility of speech. More speakers or speakers with more extreme pitch—such as very low-pitched males or high-pitched females—could be used instead.

In situations where it is desirable to preserve the identity of the speaker, or at least to enhance the ability to distinguish different speakers, the replacement LPC coefficients may be chosen in a speaker-dependent way based on measured parameters of the currently observed speech (mean pitch, mean spectra or cepstra, or other features useful for distinguishing talkers).

In contrast, if it was desirable to further disguise the speaker, modifying the pitch and energy, such as adding a slowly randomly varying value, could also be done by an excitation module.

If further obfuscation of the speech is desired, other alternative replacements of the LPC coefficients of speech segments could be performed, as described below. First, in one embodiment, the LPC coefficients of the syllable could be replaced with the LPC coefficients from other consonant sounds, e.g. /f/ or /sh/. In a second embodiment, the LPC coefficients for each syllable could be replaced with coefficients from a random phonetic unit spoken by one or more different speakers. In a third embodiment, if speech is detected, then the LPC coefficients for syllables and for unvoiced segments could be replaced with coefficients from phonetic units by other speakers, where different phonetic units are used at two adjacent segments. In a further embodiment, a tone or synthesized vowel or other sounds could be used as the replacement sound from which the transfer function is computed.

In one aspect, the identity of the replacement vocalic sound is independent of the identity of the syllable being replaced. In an additional aspect, the selection of the replacement sound transfer function could be randomized.

LPC Analysis

In one aspect, the speech is sampled at 16 kHz and a 16 pole LPC model is used, as described in J. Makhoul, "Linear Prediction: A Tutorial Review," Proceedings of the IEEE, Vol. 63, No. 4, ppl 561-580, April 1975, the contents of which are incorporated herein by reference. The LPC coefficients, $LPC_{si}$, are computed for each of the selected "substitute" vocalics. The LPC coefficients representing L frames, $LPC_{si}$ (0, . . . , L−1), are substituted into the LPC model for the vocalic portion of a syllable of M frames, $LPC_m(0, \ldots, M-1)$ by replacing the first min (L,M) LPC frames. If M>L, then the coefficients from the last frame are used to pad until there are M frames.

Using the modified LPC coefficients in vocalic syllable frames, speech is synthesized with the LPC pitch and gain information computed from the original speaker, producing mostly unintelligible speech, as described in step 1010 of FIG. 1.

Non-speech sounds, or environmental sounds, are processed in exactly the same way, except that for most non-speech sounds, little, if any, of the sound should be identified as a vocalic syllable, and therefore, the non-speech sound is modified only by the distortion caused by LPC modeling.

Example of Processed Speech

Figure 2:
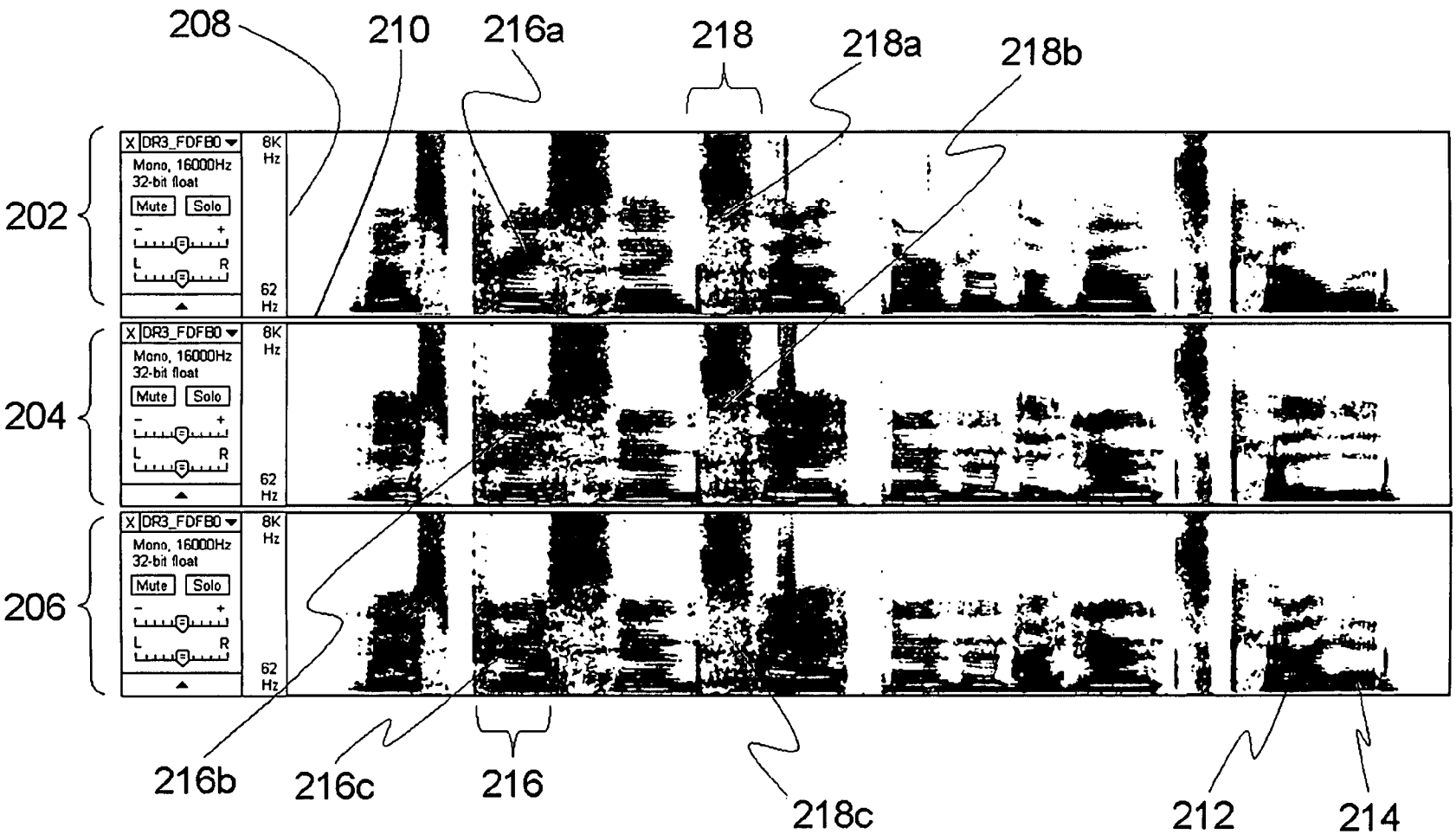
FIG. 2 depicts a plurality of spectrograms representing an original speech signal in comparison to a processed speech signal where at least one vocalic region is replaced by a vocalic sound.

FIG. 2 is an example of several spectrograms 202, 204, 206 showing how the speech formants are modified after processing using two different vocalic pairs. The top spectrogram 202 is a spectrogram of the original, unprocessed sentence DR3_FDFB0_SX148 from the TIMIT corpus. The vertical axis 208 is frequency, the horizontal axis 210 is time, and the levels of shading corresponds to amplitude at a particular frequency and time, where lighter shading 212 is stronger than darker shading 214. The middle spectrogram 204 and bottom spectrogram 206 are examples of processed speech where the vocalic regions have been processed using the LPC coefficients from two other speakers. In the middle spectrogram 204, the replacement vowel is always /uw/. In the bottom spectrogram 206, the replacement vowels are /uw/ and /ay/. Note that a vocalic segment 216 for the two processed versions 216*b*, 216*c* is different from the original on top 216*a*, while the spectral characteristics of the non-vocalic segments 218*a*, 218*b*, 218*c* are preserved. The spectrograms were created using Audacity from http://audacity.sourceforge.net/.

Intelligibility

An intelligibility study was performed with 12 listeners to compare the intelligibility of processed and unprocessed speech and the recognition of processed and unprocessed environmental sounds. In the study, audio files were played to listeners who were asked to distinguish the type of the stimulus (speech, sound or both) and to identify the words and sounds they heard. The listener response was recorded after a single presentation (to simulate a real-time monitoring scenario) and again after the listener was allowed to replay the sound as many times as desired.

The recognition of environmental sounds was relatively similar for the processed environmental sounds (78% and 83% correct for processed one listen and many listens, respectively) and unprocessed environmental sounds (85% and 86% correct for unprocessed one listen and many listens, respectively). When speech and an environmental sound were both present, the percentage of correctly recognized words is significantly lower (3% and 17% for one listen and many listens, respectively). When the voicing detector correctly detected at least 95% of the vocalic regions in a processed sentence, the word recognition rate when a processed sentence is heard once is 7%; and 17% when the processed sentence is played as many times as desired.

Although pitch is generally preserved by the processing steps described herein, people's unique voices are not easily identified because the substituted vocal tract functions used are not that of the speaker. In addition, since the prosodic information is preserved, a listener can still determine whether a statement or question was spoken.

Alternative Implementations

While the implementation presented here is built around the widely studied auto-correlation-based LPC vocoding system, other modeling methods are applicable, including the Multi-Band Excitation ("MBE") vocoder, which separates a speech signal into voiced (periodic) and unvoiced (noise-like) portions with an analysis-by-synthesis method that incorporates pitch as one of the modeled parameters. Griffin, Daniel W. Multi-band excitation vocoder Massachusetts Institute of Technology, 1987 Ph.D. thesis http://hdl.handle.net/1721.1/4219, the contents of which are incorporated herein by reference. In this way the pitch, vocal tract transfer function, and residual (unvoiced portion) are all estimated together. The ratio of the voiced output to the unvoiced output provides a similar measure of the degree of voicing as the autocorrelation method we describe above. The use of a mixed-excitation method has the added possible benefit of separating the vocalic (voiced) portion of the speech so that it can be processed without affecting the unvoiced remainder. Another variation on the implementation could use the cepstrum to estimate the pitch, voicing, and vocal tract transfer function. In this method, the lower cepstral coefficients describe the shape of the vocal tract transfer function and the higher cepstral coefficients exhibit a peak at a location corresponding to the pitch period during voiced or vocalic speech. Childers, D. G., D. P. Skinner, and R. C. Kemeraitt, "The cepstrum: A guide to processing," Proceedings of the IEEE, Vol. 65, No 10, pp. 1428-1443, 1977, the contents of which are herein incorporated by reference.

Likewise, while the voicing ratio is what was used to identify vocalic segments in the embodiment described above, various approaches to voiced-speech identification can be used, including classification of the spectral shape. These various techniques are well known in the art. For instance, the 1982 U.S. D.O.D. standard 1015 LPC-10e vocoder includes a discriminant classifier that incorporates zero crossing frequency, spectral tilt, and spectral peakedness to make voicing decisions. J. Campbell and T. Tremain, "Voiced/unvoiced classification of speech with applications to the U.S. Government LPC-10e algorithm," IEEE Int. Conf Acoust. Sp. Sig. Proc., 1986 p. 473-476; and R. Golberg and L. Riek, A Practical Handbook of Speech Coders, CRC Press, 2000; the contents of which are herein incorporated by reference.

In another embodiment, the system benefits from separating the incoming signal into rapidly-varying and slowly-varying components. That is, the frequency spectrum of speech varies fairly rapidly, while various environmental sounds (sirens, whistles, wind, rumble, rain) do not. These slowly varying sounds (sounds with slowly changing spectra) are not speech and thus do not need to be altered by the algorithm, even if they co-occur with speech. Various well known and venerable algorithms exist in the art which attempt to separate 'foreground' speech from slowly-varying 'background' noise by maintaining a running estimate of the long term 'background' and subtracting it from the input signal to extract the 'foreground'. S. F. Boll, Suppression of acoustic noise in speech using spectral subtraction, IEEE Trans. Acoust., Speech, Signal Process., vol. 27, pp. 113-120, April 1979; the contents of which are herein incorporated by reference. By employing this sort of separation in conjunction with previously disclosed methods for voiced-speech identification and modification, the signal modifications performed by the system may be restricted to the "foreground" and the system can be made more robust in varied and noisy environments.

Figure 3:
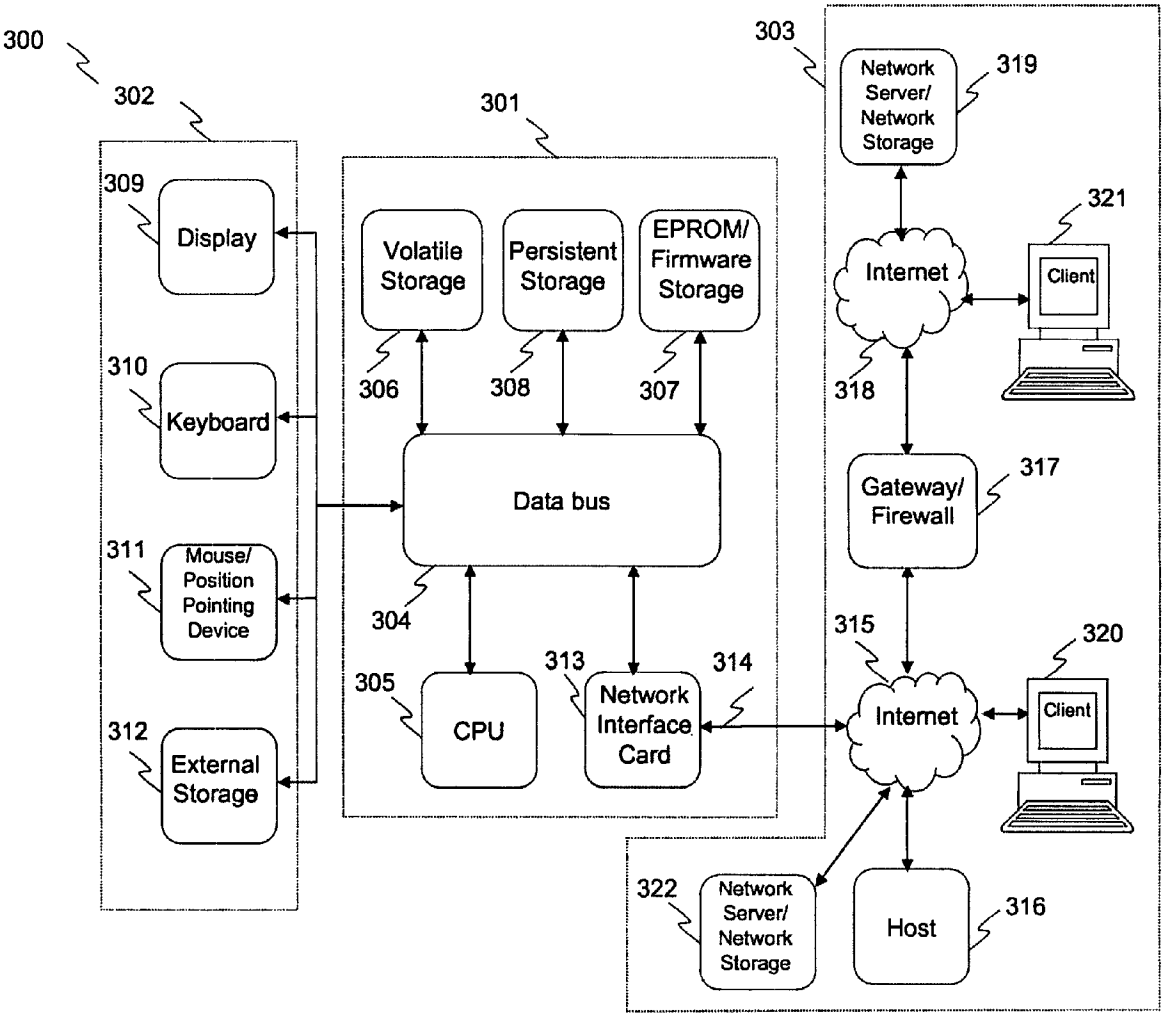
FIG. 3 illustrates an exemplary embodiment of a computer platform upon which the inventive system may be implemented.

FIG. 3 is a block diagram that illustrates an embodiment of a computer/server system 300 upon which an embodiment of the inventive methodology may be implemented. The system 300 includes a computer/server platform 301, peripheral devices 302 and network resources 303.

The computer platform 301 may include a data bus 304 or other communication mechanism for communicating information across and among various parts of the computer platform 301, and a processor 305 coupled with bus 301 for processing information and performing other computational and control tasks. Computer platform 301 also includes a volatile storage 306, such as a random access memory (RAM) or other dynamic storage device, coupled to bus 304 for storing various information as well as instructions to be executed by processor 305. The volatile storage 306 also may be used for storing temporary variables or other intermediate information during execution of instructions by processor 305. Computer platform 301 may further include a read only memory (ROM or EPROM) 307 or other static storage device coupled to bus 304 for storing static information and instructions for processor 305, such as basic input-output system (BIOS), as well as various system configuration parameters. A persistent storage device 308, such as a magnetic disk, optical disk, or solid-state flash memory device is provided and coupled to bus 301 for storing information and instructions.

Computer platform 301 may be coupled via bus 304 to a display 309, such as a cathode ray tube (CRT), plasma display, or a liquid crystal display (LCD), for displaying information to a system administrator or user of the computer platform 301. An input device 320, including alphanumeric and other keys, is coupled to bus 301 for communicating information and command selections to processor 305. Another type of user input device is cursor control device 311, such as a mouse, a trackball, or cursor direction keys for communicating direction information and command selections to processor 304 and for controlling cursor movement on display 309. This input device typically has two degrees of freedom in two axes, a first axis (e.g., x) and a second axis (e.g., y), that allows the device to specify positions in a plane.

An external storage device 312 may be connected to the computer platform 301 via bus 304 to provide an extra or removable storage capacity for the computer platform 301. In an embodiment of the computer system 300, the external removable storage device 312 may be used to facilitate exchange of data with other computer systems.

The invention is related to the use of computer system 300 for implementing the techniques described herein. In an embodiment, the inventive system may reside on a machine such as computer platform 301. According to one embodiment of the invention, the techniques described herein are performed by computer system 300 in response to processor 305 executing one or more sequences of one or more instructions contained in the volatile memory 306. Such instructions may be read into volatile memory 306 from another computer-readable medium, such as persistent storage device 308. Execution of the sequences of instructions contained in the volatile memory 306 causes processor 305 to perform the process steps described herein. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 305 for execution. The computer-readable medium is just one example of a machine-readable medium, which may carry instructions for implementing any of the methods and/or techniques described herein. Such a medium may take many forms, including but not limited to, non-volatile media, volatile media, and transmission media. Non-volatile media includes, for example, optical or magnetic disks, such as storage device 308. Volatile media includes dynamic memory, such as volatile storage 306. Transmission media includes coaxial cables, copper wire and fiber optics, including the wires that comprise data bus 304. Transmission media can also take the form of acoustic or light waves, such as those generated during radio-wave and infra-red data communications.

Common forms of computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, an EPROM, a FLASH-EPROM, a flash drive, a memory card, any other memory chip or cartridge, a carrier wave as described hereinafter, or any other medium from which a computer can read.

Various forms of computer readable media may be involved in carrying one or more sequences of one or more instructions to processor 305 for execution. For example, the instructions may initially be carried on a magnetic disk from a remote computer. Alternatively, a remote computer can load the instructions into its dynamic memory and send the instructions over a telephone line using a modem. A modem local to computer system 300 can receive the data on the telephone line and use an infra-red transmitter to convert the data to an infra-red signal. An infra-red detector can receive the data carried in the infra-red signal and appropriate circuitry can place the data on the data bus 304. The bus 304 carries the data to the volatile storage 306, from which processor 305 retrieves and executes the instructions. The instructions received by the volatile memory 306 may optionally be stored on persistent storage device 308 either before or after execution by processor 305. The instructions may also be downloaded into the computer platform 301 via Internet using a variety of network data communication protocols well known in the art.

The computer platform 301 also includes a communication interface, such as network interface card 313 coupled to the data bus 304. Communication interface 313 provides a two-way data communication coupling to a network link 314 that is connected to a local network 315. For example, communication interface 313 may be an integrated services digital network (ISDN) card or a modem to provide a data communication connection to a corresponding type of telephone line. As another example, communication interface 313 may be a local area network interface card (LAN NIC) to provide a data communication connection to a compatible LAN. Wireless links, such as well-known 802.11a, 802.11b, 802.11g and Bluetooth may also used for network implementation. In any such implementation, communication interface 313 sends and receives electrical, electromagnetic or optical signals that carry digital data streams representing various types of information.

Network link 313 typically provides data communication through one or more networks to other network resources. For example, network link 314 may provide a connection through local network 315 to a host computer 316, or a network storage/server 317. Additionally or alternatively, the network link 313 may connect through gateway/firewall 317 to the wide-area or global network 318, such as an Internet. Thus, the computer platform 301 can access network resources located anywhere on the Internet 318, such as a remote network storage/server 319. On the other hand, the computer platform 301 may also be accessed by clients located anywhere on the local area network 315 and/or the Internet 318. The network clients 320 and 321 may themselves be implemented based on the computer platform similar to the platform 301.

Local network 315 and the Internet 318 both use electrical, electromagnetic or optical signals that carry digital data streams. The signals through the various networks and the signals on network link 314 and through communication interface 313, which carry the digital data to and from computer platform 301, are exemplary forms of carrier waves transporting the information.

Computer platform 301 can send messages and receive data, including program code, through the variety of network(s) including Internet 318 and LAN 315, network link 314 and communication interface 313. In the Internet example, when the system 301 acts as a network server, it might transmit a requested code or data for an application program running on client(s) 320 and/or 321 through Internet 318, gateway/firewall 317, local area network 315 and communication interface 313. Similarly, it may receive code from other network resources.

The received code may be executed by processor 305 as it is received, and/or stored in persistent or volatile storage devices 308 and 306, respectively, or other non-volatile storage for later execution. In this manner, computer system 301 may obtain application code in the form of a carrier wave.

Finally, it should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein. The present invention has been described in relation to particular examples, which are intended in all respects to be illustrative rather than restrictive. Those skilled in the art will appreciate that many different combinations of hardware, software, and firmware will be suitable for practicing the present invention. For example, the described software may be implemented in a wide variety of programming or scripting languages, such as Assembler, C/C++, perl, shell, PHP, Java, etc.

Although various representative embodiments of this invention have been described above with a certain degree of particularity, those skilled in the art could make numerous alterations to the disclosed embodiments without departing from the spirit or scope of the inventive subject matter set forth in the specification and claims. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. Also, various aspects and/or components of the described embodiments may be used singly or in any combination in the system for reducing speech intelligibility. It is intended that all matter contained in the above description or shown in the accompanying drawings shall be interpreted as illustrative only and not limiting.

What is claimed is:

1. A method for reducing speech intelligibility while preserving environmental sounds, the method comprising:

receiving an audio signal;

processing the audio signal to separate a vocalic region that comprises vowels;

computing a representation of at least the vocalic region, the representation including at least a vocal tract transfer function and an excitation;

replacing the vocal tract transfer function of the vocalic region with a replacement sound transfer function of a replacement sound to create a modified vocal tract transfer function; and synthesizing a modified audio signal of at least the vocalic region from the modified vocal tract transfer function and the excitation.

2. The method of claim 1, further comprising substituting the audio signal of at least the vocalic region with the modified audio signal to create an obfuscated audio signal.

3. The method of claim 1, further comprising processing the audio signal using a Linear Predictive Coding ("LPC") technique.

4. The method of claim 3, further comprising computing LPC coefficients of the replacement sound and the vocalic region, and replacing the LPC coefficients of the vocalic region with the LPC coefficients of the replacement sound.

5. The method of claim 1, further comprising processing the audio signal using a cepstral technique.

6. The method of claim 1, further comprising processing the audio signal using a Multi-Band Excitation ("MBE") vocoder.

7. The method of claim 1, further comprising identifying syllables within the vocalic region before computing the vocal tract transfer function.

8. The method of claim 7, further comprising identifying the syllables within each vocalic region by identifying voiced segments and identifying syllable boundaries.

9. The method of claim 8, further comprising identifying vocalic syllables within the range of human speech by evaluating a pitch and a voicing ratio computed by a voicing detector.

10. The method of claim 1, further comprising selecting a vocalic sound as the replacement sound.

11. The method of claim 1, further comprising selecting a tone or a synthesized vowel as the replacement sound.

12. The method of claim 10, further comprising selecting a vocalic sound spoken by another speaker as the replacement sound.

13. The method of claim 1, further comprising selecting the replacement sound independently of the vocal tract transfer function being replaced.

14. The method of claim 1, further comprising randomly selecting the replacement sound.

15. The method of claim 1, further comprising replacing each vocal tract transfer function with a different replacement sound transfer function.

16. The method of claim 1, further comprising modifying the excitation.

17. The method of claim 1, further comprising, upon receiving the audio signal, separating the audio signal into rapidly-varying components and slowly-varying components.

18. A system for reducing speech intelligibility while preserving environmental sounds, the system comprising:

a receiving module for receiving an audio signal;

a voicing detector for processing the audio signal to separate a vocalic region that comprises vowels;

a computation module for computing a representation of at least the vocalic regions, the representation including at least a vocal tract transfer function and an excitation;

a replacement module for replacing the vocal tract transfer function of the vocalic region with a replacement vocal tract transfer function of a replacement sound to create a modified vocal tract transfer function; and an audio synthesizer for synthesizing a modified audio signal of at least the vocalic region from the modified vocal tract transfer function and the excitation.

19. The system of claim 18, further comprising a substitution module for substituting the audio signal of at least the vocalic region with the modified audio signal to create an obfuscated audio signal.

20. The system of claim 18, wherein the audio signal is processed using a Linear Predictive Coding ("LPC") technique.

21. The system of claim 20, further comprising an LPC computation voicing detector to compute LPC coefficients of the replacement sound and the vocalic region, and wherein the replacement module replaces the LPC coefficients of the vocalic region with the LPC coefficients of the replacement sound.

22. The system of claim 18, wherein the audio signal is processed using a cepstral technique.

23. The system of claim 18, wherein the audio signal is processed using a Multi-Band Excitation ("MBE") vocoder.

24. The system of claim 18, further comprising a vocalic syllable detector to identify the syllables within the vocalic region before computing the vocal tract transfer function.

25. The system of claim 24, wherein the syllable detector identifies the syllables by identifying voiced segments and syllable boundaries.

26. The system of claim 25, wherein the syllable detector identifies vocalic syllables within the range of human speech by evaluating the pitch and voicing ratio computed by a voicing detector.

27. The system of claim 18, wherein the replacement module selects a vocalic sound as the replacement sound.

28. The system of claim 18, wherein the replacement module selects a tone or synthesized vowel as the replacement sound.

29. The system of claim 27, wherein the replacement module replaces the vocal tract transfer function of each vocalic region with a vocalic sound spoken by another speaker.

30. The system of claim 18, wherein the replacement module selects the replacement sound independently of the vocal tract transfer function being replaced.

31. The system of claim 18, wherein the replacement module randomly selects the replacement sound.

32. The system of claim 18, wherein the replacement module replaces each vocal tract transfer function with a different replacement sound transfer function.

33. The system of claim 18, further comprising an excitation module for modifying the excitation.

34. The system of claim 18, wherein the receiving module, upon receiving the audio signal, separates the audio signal into rapidly-varying components and slowly-varying components.

* * * * *